US005213325A

United States Patent [19]

Malavazos et al.

[11] Patent Number: 5,213,325

[45] Date of Patent: May 25, 1993

[54] TILTABLE BOARD AND ROLLING BALL GAME MECHANISM

[76] Inventors: Alex Malavazos, 36 Bridal Path Ct., San Ramon, Calif. 94583; Gregory Malavazos, 42 Meadow Ct., Walnut Creek, Calif. 94595; Constantine Malavazos, 1538 Castro St., San Leandro, all of Calif. 94577

[21] Appl. No.: 717,416

[22] Filed: Jun. 17, 1991

[51] Int. Cl.[5] ..... A63B 67/14; A63F 7/00; A63F 7/38

[52] U.S. Cl. ..... 273/110; 273/109; 273/115

[58] Field of Search ..... 273/109, 110, 113, 115

[56] References Cited

U.S. PATENT DOCUMENTS

| | | | |
|---|---|---|---|
| 1,851,285 | 3/1932 | Margolith | 273/116 |
| 3,384,374 | 5/1968 | Boothe | 273/116 |
| 3,554,553 | 1/1971 | Hayashi | 273/110 |
| 3,636,650 | 1/1972 | Honig | 273/110 |
| 3,751,038 | 8/1973 | O'Keefe | 273/110 |
| 3,785,650 | 1/1974 | Halliburton | 273/110 |
| 3,815,917 | 6/1974 | Brown | 273/110 |
| 3,938,807 | 2/1976 | Luthi | 273/110 |
| 4,034,985 | 7/1977 | Breslow et al. | 273/110 |
| 4,055,341 | 10/1977 | Martinez | 273/110 |
| 4,076,243 | 2/1978 | Davis | 273/110 |
| 4,089,526 | 5/1978 | Olving | 273/110 |
| 4,094,507 | 6/1978 | Kauffmann | 273/110 |
| 4,216,963 | 8/1980 | Boucher | 273/110 |
| 4,248,427 | 2/1981 | Vierimaa | 273/110 |

FOREIGN PATENT DOCUMENTS

| | | | |
|---|---|---|---|
| 85723 | of 1965 | France | 273/110 |
| 349912 | 12/1960 | Switzerland | 273/110 |

*Primary Examiner*—V. Millin
*Assistant Examiner*—Raleigh W. Chiu

[57] ABSTRACT

An amusement device has a housing with a chamber in which a game board is disposed. A player endeavors to guide a rolling ball on the board by manipulating a control lever to tilt the board in any selected direction. The board is supported by a tiltable shaft which is below the center of the board. A rigid link extends between the shaft and control lever and is connected to each by pivot couplings which constrain the shaft and board to tilt in synchronism with the lever. Compression springs in coaxial relationship with the shaft and control lever act to bias the board towards a horizontal orientation and the shaft and lever supports prevent rotational motion of such components about their own longitudinal axes. In a preferred embodiment, the board has openings through which the ball may drop and ball retrieval components detect the particular region of the board at which the ball was dropped and return the ball to the board. The construction precisely positions the board in response to control lever movements and enables simple interchanging of the board with other boards having different surface features.

24 Claims, 10 Drawing Sheets

TILTABLE BOARD AND ROLLING BALL GAME MECHANISM

TECHNICAL FIELD

This invention relates to amusement devices and more particularly to game apparatus of the type with which a player endeavors to guide the movement of a rolling ball on a game board surface by control lever manipulations which tilt the board in any selected direction.

BACKGROUND OF THE INVENTION

Game devices of the type which are typically found in arcades and which are usually coin operated tend to have a violence oriented thematic content. The player manipulates controls in an endeavor to shoot down or otherwise destroy targets of various types. Many people have reservations about the desirability of games of this kind and particularly when they are used by children.

Game installations of the kind in which the player controls the inclination of a game board in order to travel a rolling ball along a selected path are inherently less violence oriented. Typically, the object is to guide the ball along a particular path or through a maze pattern without loss of the ball through openings in the game board.

Some prior tiltable board and rolling ball game devices require direct gripping of the board or gripping of handles attached to the board and thus are not particularly suited for arcade use where players are accustomed to controlling a game by means of control levers or the like. Other prior games of of this general type do enable lever control of the board but the lever must be linked to a somewhat cumbersome double framework of the gimbal type that supports the game board in a manner which enables tilting of the board. Still others require complex and costly electrical servo mechanisms to orient the board in response to control lever movements.

Another prior game apparatus of this type avoids the need for gimbal mounting of the game board by supporting it on a tiltable shaft situated below the center of the board. A spring extends from the table to the floor of the board housing to bias the board towards a horizontal orientation. Tilting of the board in response to control lever movement is effected by a system of cables and pulleys connected between the lever and the underside of the board.

It would be advantageous if the mechanism provided for a more precise and positive control of board orientation than is realized by such a system of springs, cables and pulleys. Enjoyment of such games is enhanced if the player senses a precise tracking of board tilt with control lever positioning. For similar reasons, the mechanism should preclude any rotational looseness or play in the board orientation to a greater degree than is realizable with the system of cables and pulleys. This is particularly important in instances where the board is rectangular and fitted within a rectangular housing.

It is advantageous if the game board is interchangeable with other game boards of different design to provide for playing of a variety of different games at the same apparatus. Preferably the apparatus should enable such board interchanges with a minimum of complication and expense.

Balls which drop through openings in the tiltable board should be intercepted and returned to the board.

Prior ball retrieval structures in game apparatus of this type do not enable identification of the particular region of the board at which the ball was dropped. This would be advantageous as it would provide for a greater number of variations in the manner in which a player's score is determined. Preferably the dropped ball should be returned to the game board by motor driven means, rather than by manual operations, and this is not provided for in prior game devices of the subject type.

The present invention is directed to overcoming one or more of the problems discussed above.

SUMMARY OF THE INVENTION

In one aspect, the invention provides amusement apparatus having a game board that is secured to and supported by an upwardly extending shaft situated below the central region of the board, a shaft support that enables tilting of the shaft and board in any selected direction and a control lever and control lever support that enables pivoting of the lever in any direction. The apparatus further includes means for tilting the shaft and board in response to pivoting of the control lever whereby a player may control movement of a rolling ball on the surface of the board. The tilting means includes a rigid link extending from the control lever to the shaft, a first pivot coupling connecting the link to the shaft and a second pivot coupling connecting the link to the control lever. The first pivot coupling enables pivoting of the shaft relative to the link only about a first rotational axis that is parallel to the game board and the the second pivot coupling enables pivoting of the control lever relative to the link only about a second rotational axis that is parallel to the first rotational axis. The mechanism further includes means for preventing rotation of the shaft and control lever about their longitudinal axes.

In another aspect of the invention, the game board is situated in a externally visible chamber in a cabinet or housing. The apparatus further includes at least one rigid structural member to which both the shaft support and the control lever support are secured. This holds the shaft support and the control lever support in a unitized, fixed relationship with each other independently of the housing.

In another aspect of the invention, the game board is supported solely by the shaft and is attached to the shaft by disengageable fasteners thereby enabling quick replacement of the board by another game board of different design.

In another aspect of the invention, the game board has openings through which a ball may drop to the underlying region. Means for intercepting the dropped ball guides the ball to a retrieval location along different routes when the ball drops from different areas of the board. This enables detection of the particular area of the board at which the ball was dropped and assignment of different scorings to a player depending on the particular area at which the ball was dropped.

In another aspect of the invention, at least one tray beneath the game board intercepts dropped balls and is inclined to cause the balls to roll to a ball retrieval location. First and second spaced apart guide plates extend up from the retrieval location to a ball release location adjacent the game board. A rotatable ball carrier plate between the guide plates has at least one opening for receiving the retrieved ball and a motor turns the carrier plate to carry the ball up to the release location.

Means are provided for ejecting the ball from the carrier plate at the release location.

In another aspect of the invention, a plurality of electrical switches are secured to at least one of the shaft support and the control lever support at locations at which the switches are actuated by tilting of the control lever and shaft. This enables generation of audio effects and/or visual effects in response to such tilting.

In still another aspect, the invention provides amusement apparatus of the type with which a player endeavors to guide a rolling ball along a particular path on the surface of a game board by manipulating a control lever that controls the inclination of the board. The apparatus includes a housing with a chamber that is visible by the player and a tiltable rectangular game board in the chamber that has at least one opening through which the ball may drop. The board is rigidly fastened to the upper end of a tiltable shaft that is below a central region of the board. The shaft has an enlarged region through which a passage extends. The center of the passage is of minimum size and the upper and lower walls of the passage diverge from each other towards each end of the passage, the width of the passage being the same at the center and ends of the passage. The enlarged region of the shaft seats in a first socket cavity in a shaft support to enable tilting of the shaft and board. A pin extends through the passage in the shaft and into the shaft support to hold the enlarged region in the first socket cavity and to prevent rotational motion of the shaft and board about the longitudinal axis of the shaft. An annular spring retainer and at least one compression spring are disposed on the shaft in coaxial relationship with the shaft. The ends of the spring bear against the retainer and the shaft support to resist tilting of the shaft and game board. A control lever support is secured to a rigid structural member which extends from the shaft support, the control lever support having a second socket cavity. A tiltable control lever has an enlargement which is seated in the second socket cavity and means are provided for retaining the lever enlargement in the cavity. A rigid link is connected to the control lever by a first pivot coupling and to the shaft by a second pivot coupling, the couplings being oriented to enable pivoting of the link relative to the lever and shaft only about pivot axes that are parallel to the surface of the game board and parallel to each other.

The invention provides a tiltable board and rolling ball game apparatus in which the board inclination very precisely tracks movements of a tiltable control lever without requiring a gimbal type of support frame. The construction prevents any looseness in the rotational orientation of the board and thus further contributes to the player's sense of precise control and facilitates use of rectangular boards in rectangular chambers. Interchanging of the game board with another of different design can be accomplished quickly and easily. In the preferred form of the invention, balls which drop through the openings in the game board are automatically returned to the board and by means which enables sensing of the particular area of the board at which the ball was dropped, thereby providing for distinguishing different areas of the board for scoring purposes.

The invention, together with further aspects and advantages thereof, may be further understood by reference to the following description of the preferred embodiment and by reference to the accompanying drawings.

DETAILED DESCRIPTION OF THE PREFERRED EMBODIMENT

Figure 1:
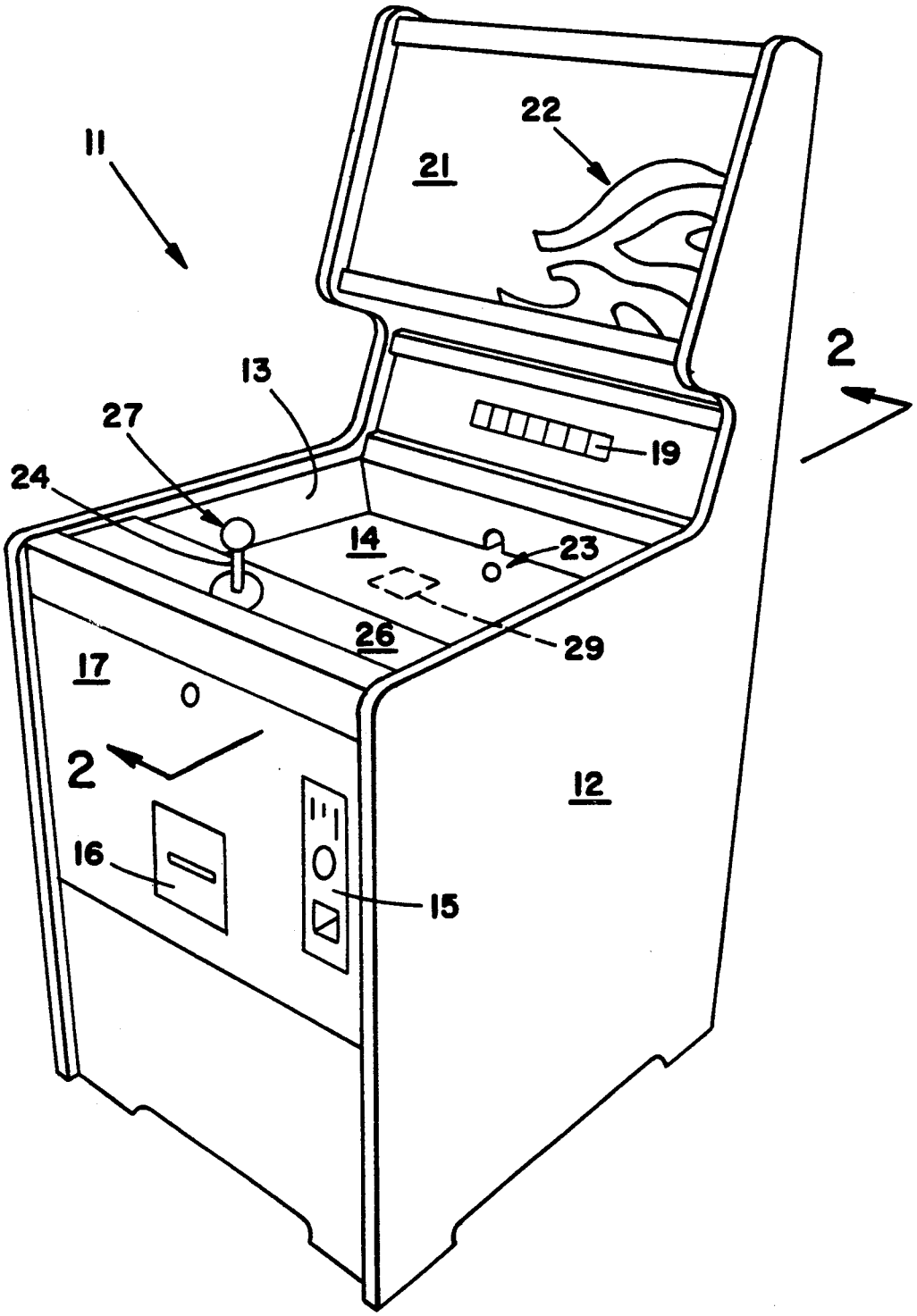
FIG. 1 is a perspective view of tiltable board and rolling ball game apparatus in accordance with the preferred embodiment of the invention.

Referring initially to FIG. 1 of the drawings, a tiltable board and rolling ball game apparatus 11 embodying the invention is preferably contained in a cabinet or housing 12 which forms a chamber 13 in which the tiltable game board 14 is disposed and which is visible to a player standing at the front of the housing.

The depicted embodiment of the invention was designed for use in commercial game arcades and is therefore provided with certain components that are customarily present in such coin operated installations. These include a coin receiving mechanism 15 and a winners ticket dispensing mechanism 16 that in this case are mounted on a lockable access door 17 at the front of housing 12, a digital score display 19 and a screen 21 at which light patterns 22 or other visual effects may be presented. Suitable detailed constructions for such components and the associated control circuits are known to those skilled in the art and therefore will not be further described. It should be recognized that the invention can also be embodied in a non-commercial game apparatus, for use in the home or elsewhere, in which case some or all of the above described components may not be present.

A player controls the inclination of the game board 14, in an endeavor to guide a rolling ball 23 on the game board, by manipulating a control lever 24. The lever 24 of this embodiment extends a short distance upward from the center of a horizontal panel 26 which is situated in front of the game board chamber 13 and has a spherical knob 27 the upper end which facilitates gripping of the lever by an operator. The lever 24 is linked to the game board support structure 29, in a manner to be hereinafter described, which causes tilting of the lever in any direction to produce a similar tilting of the game board 14.

Figure 2:
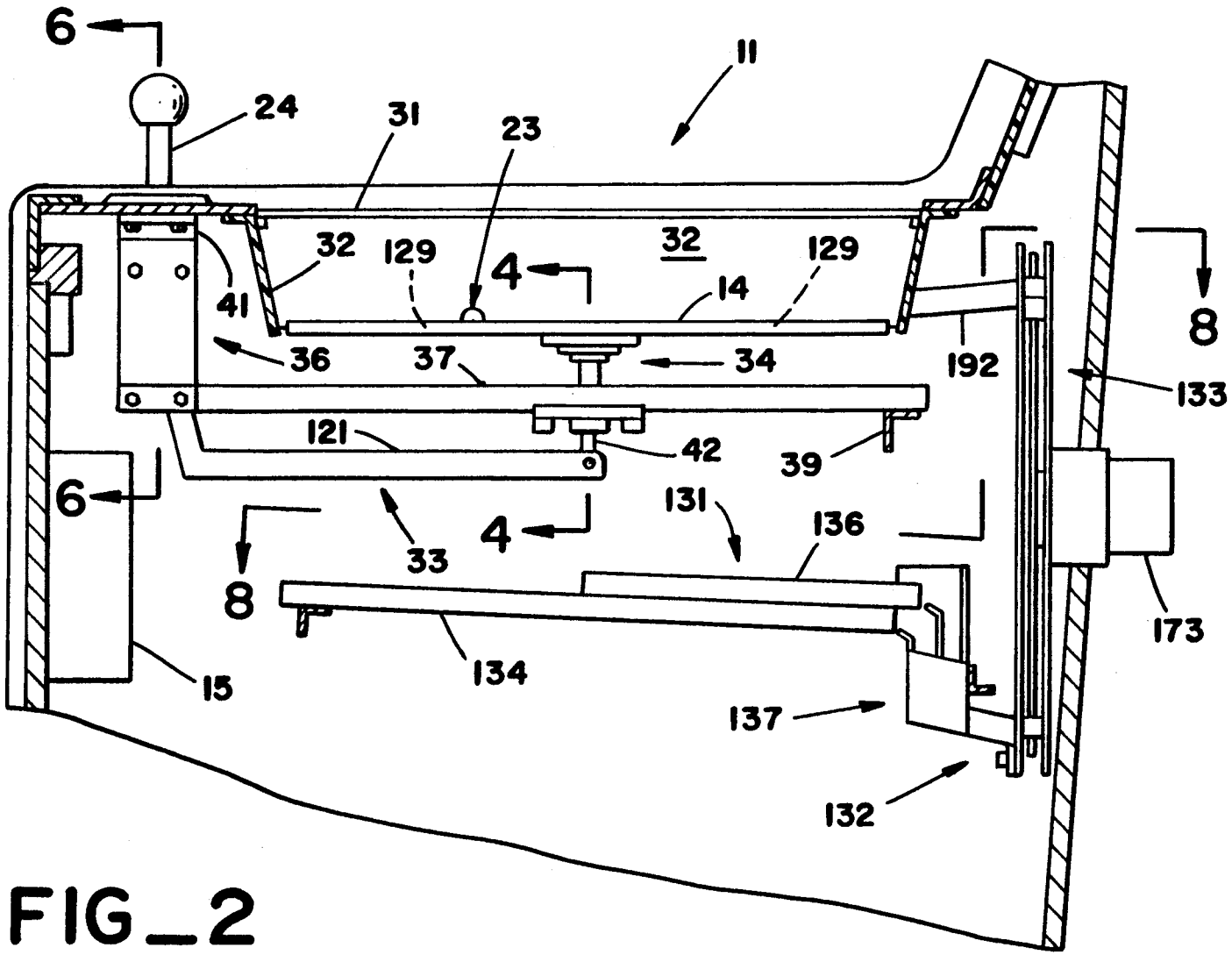
FIG. 2 is an elevation section view of a portion of the apparatus of FIG. 1 taken along line 2—2 thereof.

Referring jointly to FIGS. 1 and 2, the tiltable game board 14 is situated several inches down from the top of chamber 13 and the top of the chamber is closed by a horizontal pane 31 of glass or transparent plastic. Skirts 32 which are attached to the housing 12 extend downward from the upper perimeter of chamber 13 to locations adjacent each edge of the board 14 to prevent loss of ball 23 at the edges of the board. The skirts 32 are slightly spaced from the board 14 edges to avoid interference with the tilting movements of the board.

Figure 3:
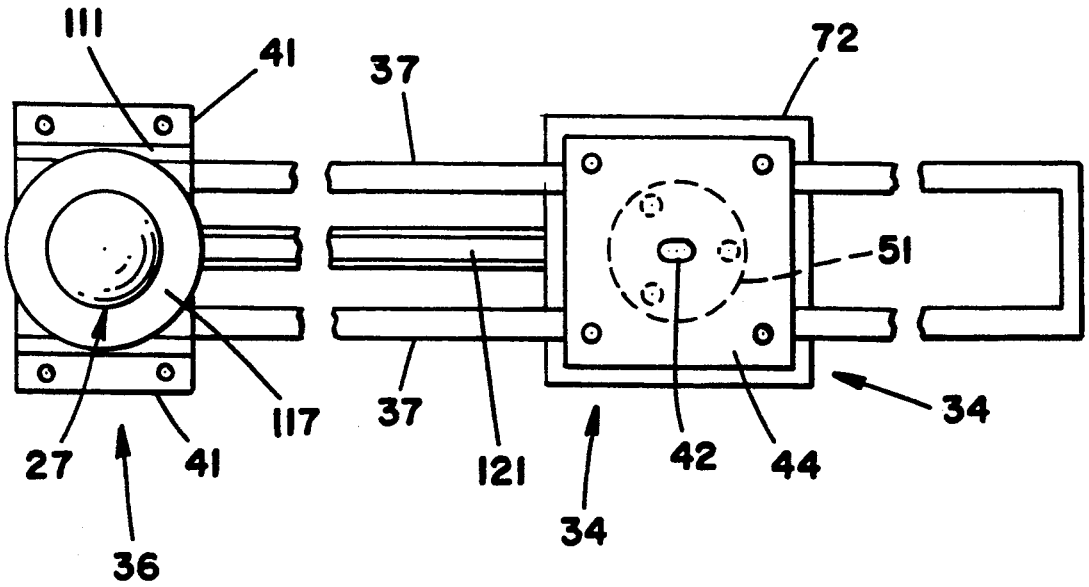
FIG. 3 is a top view of components of the apparatus of the preceeding figures that support a game board and which control the orientation of the game board.

Referring jointly to FIGS. 2 and 3, components of the mechanism 33 which tilts the game board 14 in correspondence with tilting of control lever 24 include a board positioning assembly 34 and a control lever support assembly 36. The assemblies 34 and 36 are preferably directly secured to each other, independently of connections to the housing 12, by one or more rigid structural members which in this example include a pair of parallel linear members 37 that interconnect the sides of the two assemblies. This assures a precise fixed positioning of components of the two assemblies 34 and 36 relative to each other. The unitized mechanism 33, including both assemblies 34 and 36, is then secured to housing 12 by suitable means which in this example includes a support 39 to which the back ends of members 37 are secured and which is itself secured to the housing 12 sidewalls. The front end of the unitized mechanism is support by flange like brackets 41 on control lever assembly 36 which are secured to the underside of panel 26.

Figure 4:
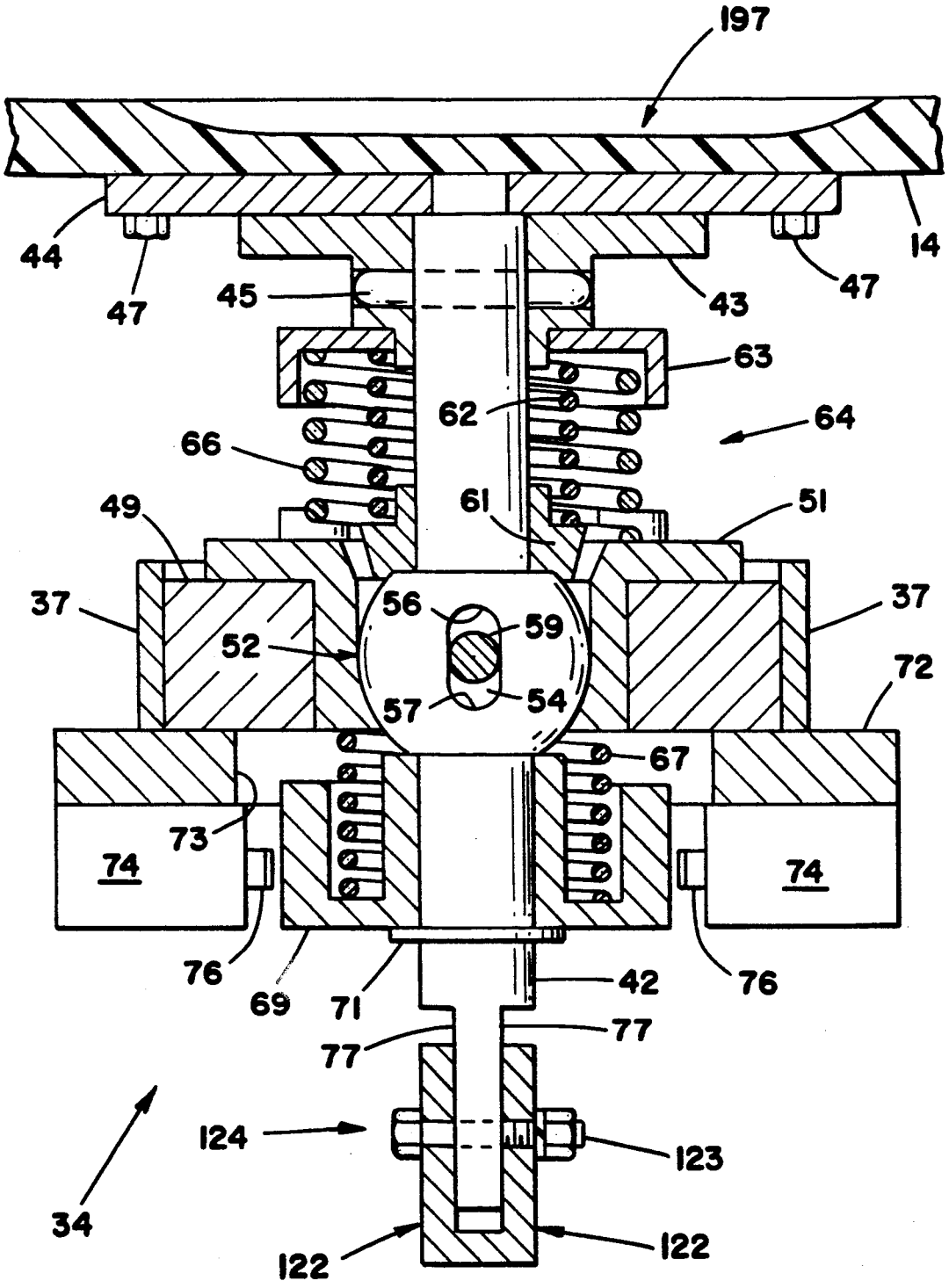
FIG. 4 is an elevation section view taken along line 4—4 of FIG. 2 and depicting mechanism which supports and positions the game board.
Figure 5:
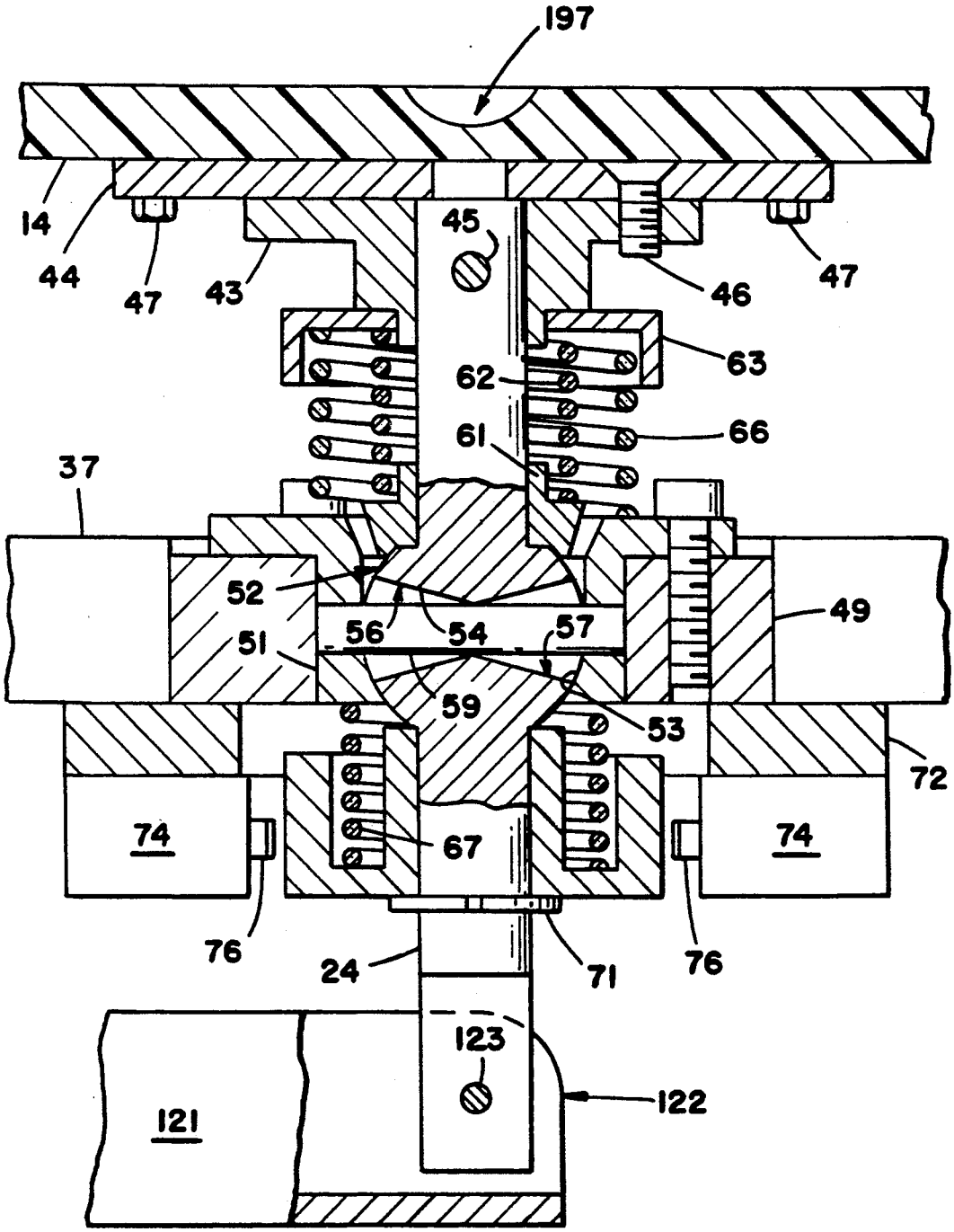
FIG. 5 is an elevation section view of the mechanism of FIG. 4 taken at right angles to the plane of FIG. 4.

Board positioning assembly 34 is situated below a central region of the game board and has a tiltable board supporting shaft 42 that is preferably under the actual center of the board so that the board is substantially balanced and there are no significant gravity induced forces acting to tilt the board. Referring now to FIGS. 4 and 5 in conjunction with FIG. 3, a flanged annular sleeve 43 encircles the upper end of shaft 42 and is secured to the shaft by a transverse press fitted pin 45. The game board rests on a rectangular platform 44 which is secured to sleeve 43 by a first set of screws 46. A second set of screws 47 secure the game board 14 to platform 44. Thus the board 14 can be easily replaced with another board of different surface design by temporarily disengaging screws 47.

To support shaft 42 in a manner which enables tilting of the shaft, a rectanglar block 49 extends between the previously described structural members 37 and is secured to each such member and has a circular opening in which an annular shaft support member 51 is seated and secured. Shaft 42 has a ball shaped enlargement 52 at an intermediate location along the length of the shaft that seats in a first socket cavity 53 in in the shaft support member 52. The wall surface of the lower portion of cavity 53 has a spherical configuration conforming to the shape of the shaft enlargement 52 and thus the shaft may be tilted away from an upright orientation in any direction.

A passage 54 extends across the shaft enlargement 52 along a diameter of the shaft and is of minimum size at the center of the enlargement. The upper and lower walls 56 and 57 of passage 54 diverge from each other towards each end of the passage and the width of the passage is uniform throughout. Shaft enlargement 52 is held in its socket cavity 53 and rotation of the shaft about its own longitudinal axis is prevented by a cylindrical pin 59 which extends through passage 54 and which has ends that extend into the shaft support member 52. The diameter of pin 59 conforms with the width of passage 54. The height of passage 54 at the center of the passage is slightly greater than the width of the passage to enable shaft 42 to pivot away from a right angled relationship with pin 59.

Tilting of the game board may be limited to a maximum of a few degrees of inclination, such as about 5° or 6° for example, as control of the rolling ball becomes increasing difficult as board inclination increases. For this purpose, an annular collar 61 encircles shaft 42 immediately above enlargement 52 and is held in abutment with the enlargement by another compression spring 62 having one end which bears against the collar and an opposite end that bears against a spring retainer 63 that encircles the shaft immediately below sleeve 43. Collar 61 has a diameter which causes it to contact the shaft support member 51 when the desired maximum degree of tilting has been reached. Collar 61 can be replaced with a larger or smaller collar if it is desired to change the degree of skill required of a player.

Means 64 are provided to create a resilient resistance to tilting of the game board 14 so that the board assumes a horizontal orientation at times when it is not being deliberately tilted. Such means 64 in this embodiment includes a pair of helical compression springs 66 and 67 disposed in coaxial relationship with shaft 42. Spring 66 is situated above enlargement 52 and has one end which bears against the spring retainer 63 and an opposite end which bears against the flanged top of support member 51. Spring 67 is below the enlargement 52 and has an upper end which bears against the bottom of shaft support member 51 and a lower end acting against another annular spring retainer 69 which encircles shaft 42 below enlargement 52 and which is held on the shaft by a snap ring 71. Springs 66 and 67 are preferably proportioned to be under compression when the board 14 is horizontal and thus continuously act to bias the board toward that orientation.

If desired, the board positioning assembly 34 may further include a switch plate 72 have a central opening 73 and which extends around the shaft 42, lower spring 67 and lower spring retainer 69. A plurality of electrical switches 74, of which there are four in this example, are secured to the underside of plate 72 and have actuators 76 positioned to be contacted and operated by the lower spring retainer 69 when the shaft 42 is tilted towards the particular switch. The switches 74 may be used to trigger the previously discussed audio effects and/or visual effects systems in response to tilting of the game board in any of a plurality of different directions.

To provide for linking of the board positioning assembly 34 with the control lever as will hereinafter be further described, shaft 42 has parallel flat areas 77 at opposite sides of the lower end portion of the shaft which areas lie in planes parallel to the structural members 37.

Figure 6:
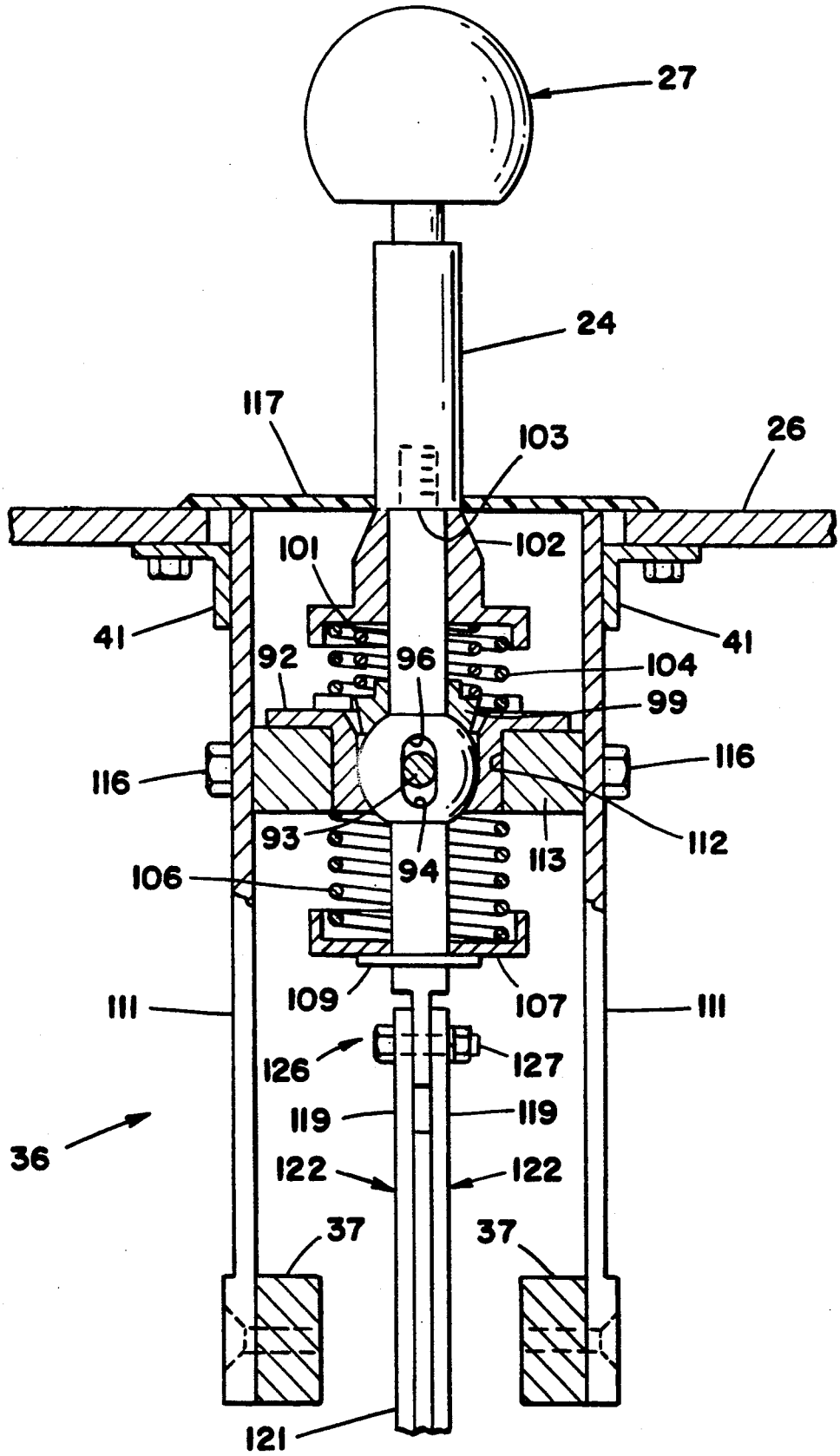
FIG. 6 is an elevation section view taken along line 6—6 of FIG. 2 and which depicts the control lever and associated mechanism.
Figure 7:
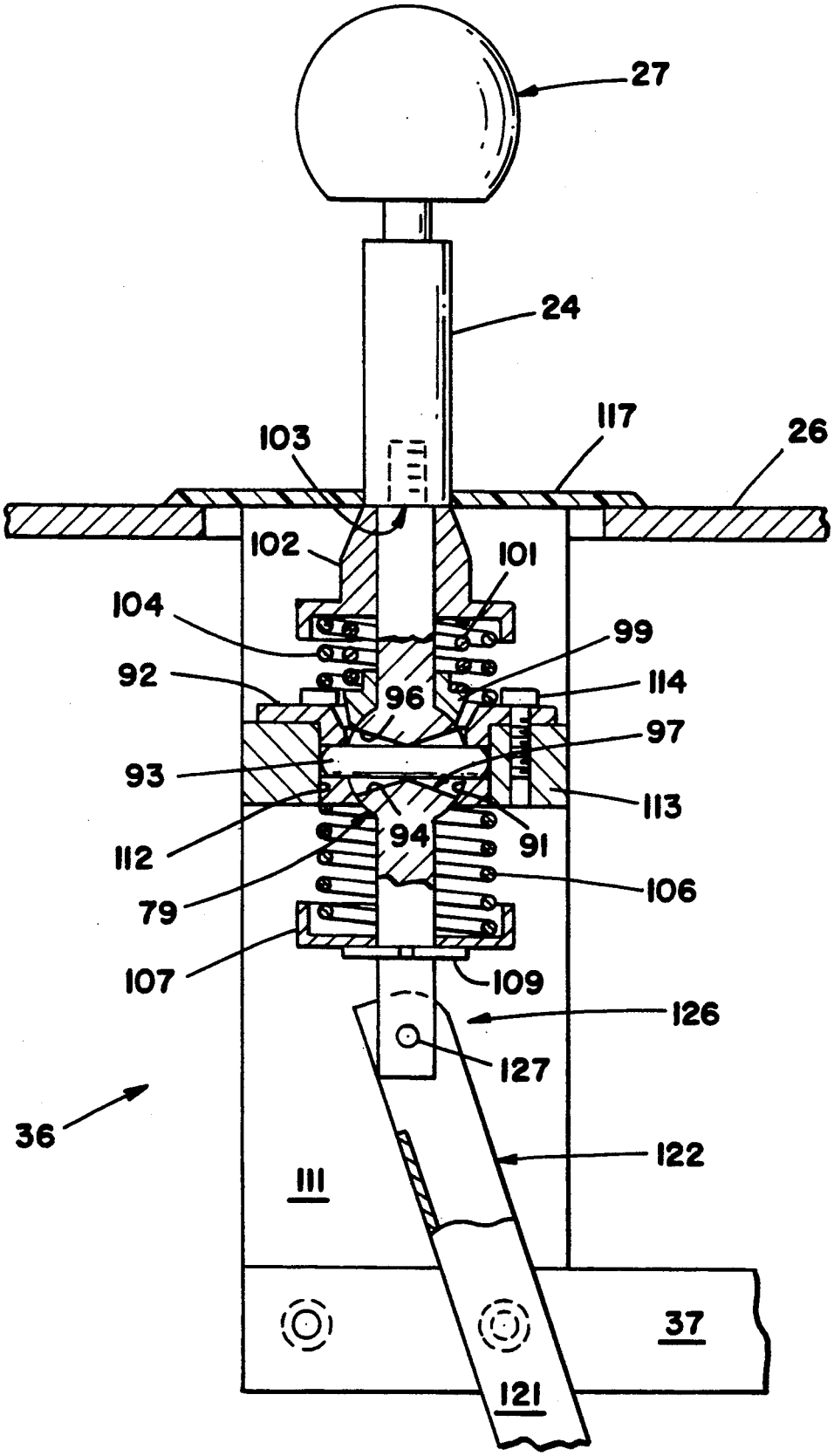
FIG. 7 is an elevation section view of the mechanism of FIG. 6 taken at right angles to the plane of FIG. 6.

Referring to FIGS. 6 and 7 in conjunction, the control lever support assembly 36 has a construction which is similar in a number of respects to that of the above described board positioning assembly. The control lever 24 has a ball shaped enlarged region 79 at an intermediate location along the length of the lever and the enlarged region seats in a socket cavity 91 in an annular control lever support member 92, the lower region of the cavity having a spherical configuration conforming to that of enlarged region of the shaft. To prevent rotation of the control lever 24 and to hold it seated in cavity 91, a cylindrical pin 93 extends through a horizontally directed passage 94 in the enlarged region 79 of the lever and has ends which extend into apertures in the lever support member 92. The width of passage 94 is uniform throughout its length and is similar to the diameter of pin 93. The height of passage 94 is slightly greater than the diameter of pin 93 at the midpoint of the passage and becomes progressively greater towards each end of the passage as the upper wall 96 and lower wall 97 of the passage diverge from each other towards the ends of the passage.

Tilting of control lever 24 is limited by an annular collar 99 that encircles the lever immediately above the enlarged region 79 and which is held in abutment with the enlarged region by a helical compression spring 101. Spring 101 is disposed in coaxial relationship with lever 24 and has one end which abuts collar 99 and an opposite end which bears against an annular spring retainer 102 that encircles the lever. Upward travel of spring retainer 102 is prevented by abutment of the retainer against a step 103 on the control lever. Collar 99 has a diameter that is smaller than the diameter of the adjacent surfaces of lever support member 92 by an amount sufficient to enable the desired maximum degree of tilting of lever 24.

Tilting of the control lever 24 away from a vertical orientation is resisted by upper and lower helical compression springs 104 and 106 respectively which are coaxial with the lever with spring 104 being above the lever support member 92 and spring 106 being below member 92. One end of upper spring 104 bears against the lever support member 92 and the upper end of spring 104 abuts spring retainer 102. The upper end of lower spring 106 bears against the underside of the lever support member 92 and the lower end of the spring 106 reacts against another spring retainer 107 that encircles lever 24 and which is retained in place by a snap ring 109. Both springs 104 and 106 are preferably proportioned to be under compression when the lever 24 is upright.

The control lever support assembly 36 has spaced apart rectangular side plates 111 which extend downward from the previously described mounting brackets 41 which attach the assembly to the underside of housing panel 26. The control lever support member 92 seats in a circular opening 112 in a rectangular mounting block 113 which extends between the side plates 111. Bolts 114 secure the support member 92 to block 113 and additional bolts 116 secure the block to the side plates 111. A flat circular flange 117, formed of flexible resilient material, is disposed on lever 24 in coaxial relationship with the lever at a location immediately above housing panel 26 to close the panel opening through which the lever extends.

Control lever 24 has parallel flat areas 119 at opposite sides of the lower end of the lever in order to engage with the front end of an angled rigid link 121 of U-shaped cross section. With reference to FIG. 2, the opposite end of link 121 engages with the bottom end of shaft 42 of the game board positioning assembly 34. Referring again to FIGS. 4 and 5, the flat lower portion of shaft 42 extends between the parallel sides 122 of link 121. A cross bolt 123 extends through the sides 122 and shaft 42 to form a first pivot coupling 124 that enables pivoting of the shaft relative to the link only about a first rotational axis, defined by the centerline of bolt 123, that is parallel to the game board 14 surface.

Referring again to FIGS. 6 and 7, the front end of link 121 engages with the control lever 24 at a second similar pivot coupling 126. In particular, the flat lower end of lever 24 extends between the sides 122 of link 121 and another cross bolt 127 extends through the link sides 122 and the lever 24. Thus the second pivot coupling 126 enables pivoting of the lever 24 relative to link 121 only about a second rotational axis, defined by the centerline of cross bolt 127, that is parallel to the previously described first rotational axis at the board positioning assembly 34.

Referring again to FIG. 2, the above described construction of the game board tilting mechanism 33 causes the control lever 24 and game board support shaft 42 to be vertical unless a player forcibly tilts the control lever. Link 121 causes the shaft 42 and thus the game board 14 to tilt in any direction that the control lever is forcibly tilted and by an amount that is determined by the degree of control lever tilting. Thus a player may cause ball 23 to roll on the game board 14 surface and may influence the speed and path of travel of the ball by appropriate manipulation of the control lever 24.

Referring jointly to FIGS. 4 to 7, the springs 66 and 67 in board positioning assembly 34 which urge the board support shaft 42 into a vertical orientation also act in a similar manner, through link 121, to urge the control lever 24 into a vertical position. Link 121 also causes the springs 104 and 106 of the control lever support assembly 36 to urge the board support shaft 42 as well as the Control lever 24 towards the vertical orientation. Thus variations of the construction are possible in which such springs 66 and 67 or 104 and 106 are absent from either the board positioning assembly or the control lever support assembly and in such variations it is preferable that the remaining springs be larger and stronger than in the embodiment described above. It is also possible, by using stronger springs, to provide only a single one of the springs 66 and 67 in the board positioning assembly 34 and/or a single one of the springs 104 and 106 in the control lever support assembly 36. The herein described embodiment of the invention is preferred as it provides for a compact assembly of components which is highly sensitive to a player's manipulation of the control lever 24, minimizes resistance to such manipulations and causes the game board 14 to track control lever positionings with extreme precision.

Referring again to FIG. 2, in most cases the game board 14 has one or more openings 129 through which the ball 23 may drop to the region which underlies the board. This enhances enjoyment of the game as the player must exercise skill to avoid such loss of the ball. Means 131 are provided below the game board 14 for intercepting the dropped ball 23 and for guiding the ball to a retrieval location 132 at which a ball lifting mechanism 133 receives the ball and returns it to the game board. The ball intercepting means 131 of this embodiment enables detection of the particular area of the board 14 at which the ball was lost to provide scoring procedures that assign different penalties for loss of the ball at different specific areas of the board.

Such means 131 includes a first tilted rectangular tray 134 secured within housing 12 below game board 14 and which has an area equal to that of the board. A second smaller tilted rectangular tray 136 has an area equal to one half the area of board 14 and overlays the rear half of the first tray 134. Both trays 134 and 136 slope downward towards the back of housing 12 to feed the intercepted ball into a ball collector 137 which is situated behind the trays.

Figure 8:
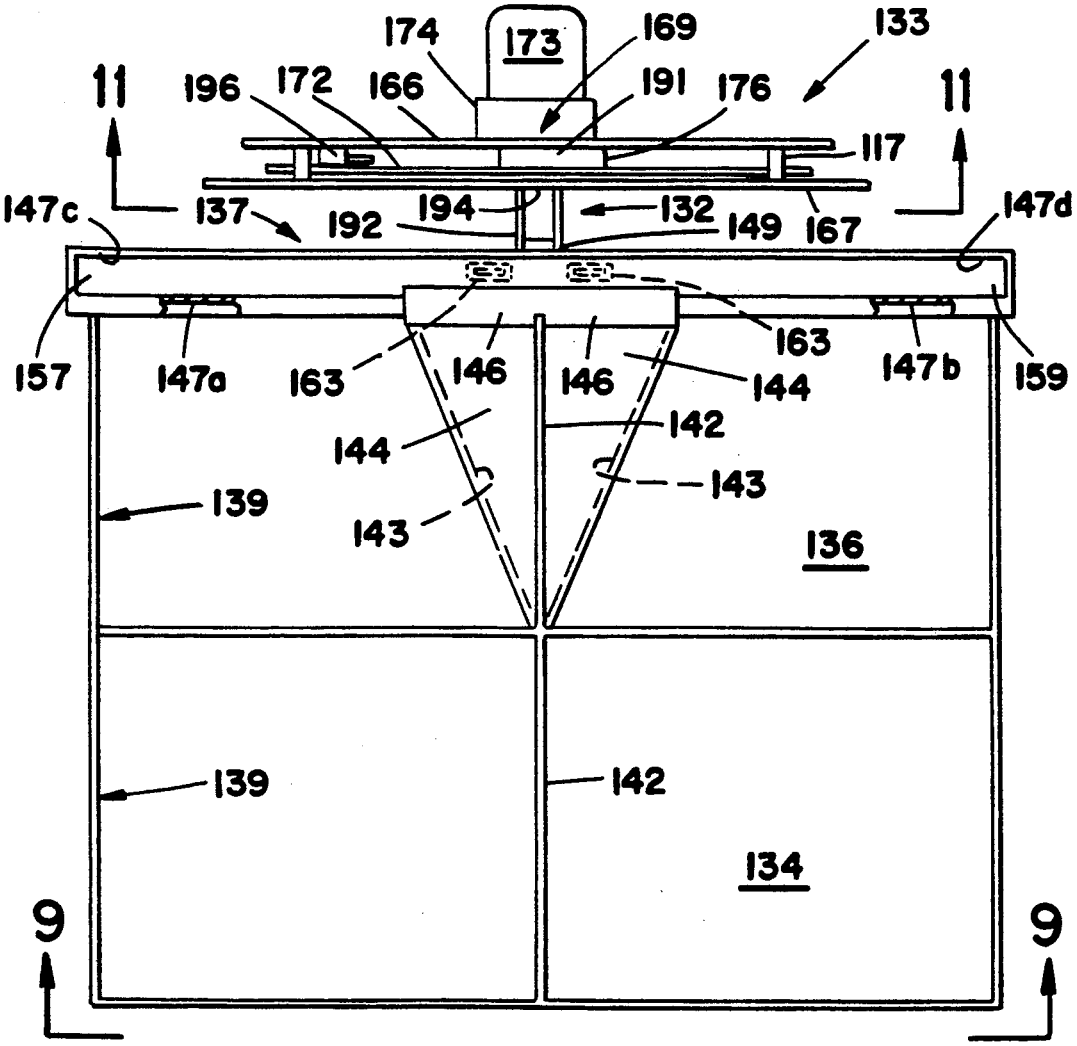
FIG. 8 is a plan view taken along angled line 8—8 of FIG. 2 depicting components which retrieve and return balls which drop through the game board of the apparatus.
Figure 9:
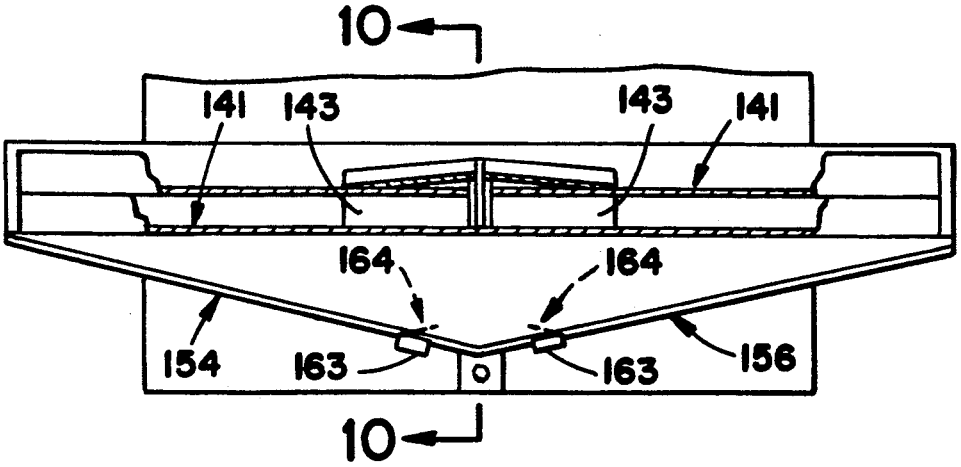
FIG. 9 is a broken out elevation view taken along line 9—9 of FIG. 8.

Referring jointly to FIGS. 8 and 9, the front edges and side edges of both trays 134 and 136 have upwardly directed rims 139 to assure that the intercepted ball travels to the lower back edges of the trays which lack such rims and define openings 141 through which the ball may drop into the collector 137. Each tray 134 and 136 also has an upstanding partition 142 extending from the front to the back of the tray midway between the sides of the tray. Thus the construction forms four different routes for returning the dropped ball to the retrieval location 132. If the ball is dropped from the front left quadrant of the game board as viewed by the player, it is returned to the left side region of collector 137 by the lower tray 134 and if it drops from the right front quadrant it is returned to the right side region of collector 137 by the lower tray. If the ball drops from the left rear quadrant of the game board it is returned to a higher location at the left side of collector 137 by the upper tray 136. A ball dropping from the right rear quadrant is delivered to a higher location at the right side of collector 137 by the upper tray 136. To assure that the ball is carried well over to the left or right side of collector 137, rather than to the central region of the collector, a pair of deflector blades 143 are situated at the rear central region of the lower tray 134 and diverge from each other towards the back of the tray. For similar reasons, a pair of inclined ramps 144 are situated at the rear central region of the upper tray 136. Ramps 144 slope downward from the central partition 142 of upper tray 136 towards each side of the tray and become increasingly broader towards the back of the tray. Each ramp 144 has an upwardly directed lip 146 at the back of the ramp to assure that a ball which drops directly on the ramp near the back of the tray is carried sidewardly rather than into the central region of collector 137.

Figure 10:
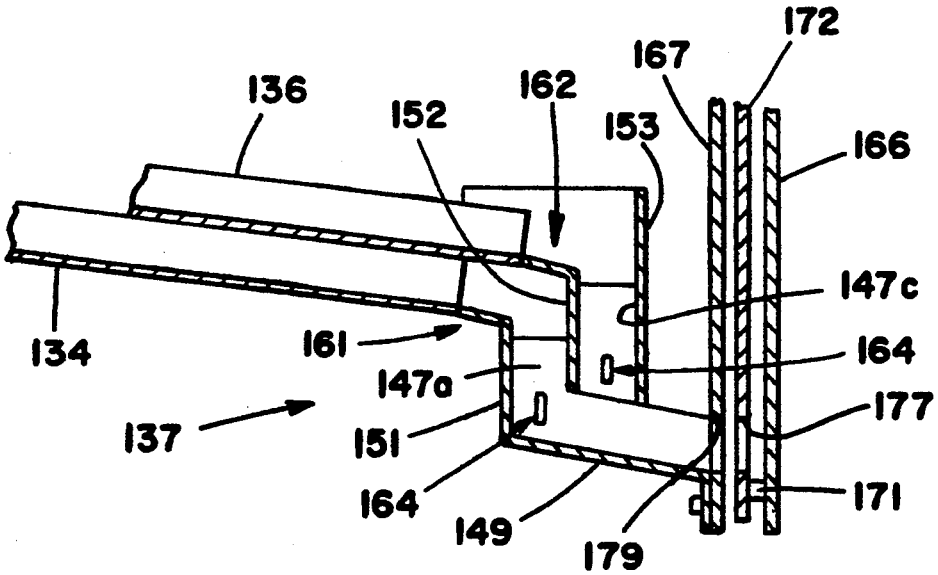
FIG. 10 is an elevation section view taken along line 10—10 of FIG. 9.

Referring to FIGS. 8 and 10 in conjunction, collector 137 has a configuration which provides four separate inclined troughs 147*a*, 147*b*, 147*c* and 147*d* for carrying the returned ball to the retrieval location 132, which location is defined by a chute 149 that extends backward from the bottom center region of the collector to the bottom center of the lifting mechanism 133. The collector 137 has a front wall 151, an intermediate wall 152 and a rearwall 153 which are parallel and spaced apart. Trough 147*a* and 147*b* are defined by collector floor regions 154 and 156 situated between front wall 151 and intermediate wall 152 and each of which slopes down to the open front end of chute 149. Troughs 147*c* and 147*d* are defined by collector floor regions 157 and 159 respectively situated between the intermediate wall 152 and rearwall 153 and each of which slopes down towards the open top of chute 149.

Front wall 151 has an inclined lip 161 positioned to carry a ball which rolls off of lower tray 134 into trough 147*a* or trough 147*b* depending on which side of the tray the ball was intercepted. Intermediate wall 152 also has an inclined lip 162 located at a higher level in position guide balls which roll off of upper tray 134 into trough 147*c* or trough 147*d*. The rearwall 153 extends to a higher level than lip 162 to assure that the ball enters one of the troughs 147*c*, 147*d*.

To provide for automatic detection of the particular quadrant of the game board at which the ball was dropped, a separate electrical switch 163 is secured to the underside of each trough 147*a* to 147*d* and has an actuator 164 that extends up through an opening in the floor of the trough in position to be depressed by passage of a ball through the particular trough and to thereby actuate the switch. Switches 163 may be connected to the scoring circuits 19 to enable use of the data in any of variety of scoring procedures. For example, a player's score may be penalized by different amounts when the ball is lost at different areas of the game board. Alternately, each switch 163 may energize a different light to indicate the area of the game board or may energize a device which generates an audible sound.

The construction of the ball intercepting means 131 may be varied by providing additional trays with additional partitions in order to distinguish between a greater number of different areas of the game board and the partitions 142 may have non-linear configurations to distinguish between separate areas of the game board that are not necessarily of rectangular outline.

Figure 11:
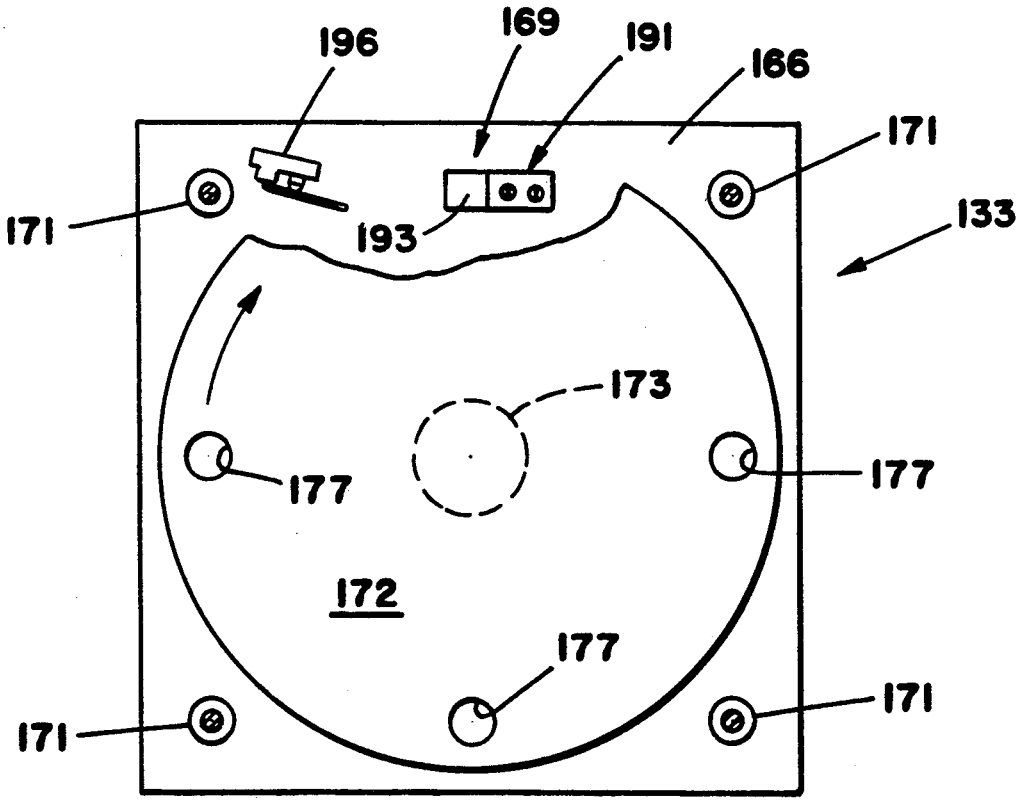
FIG. 11 is a broken out elevation section view taken along line 11—11 of FIG. 8.

Referring jointly to FIGS. 8 and 11, the ball lifting mechanism 133 includes a pair of spaced apart, parallel upright rectangular guide plates 166 and 167 which extend upward from the back of chute 149 to a ball release location 169 that is above and behind the game board. Cylindrical stand off posts 171 extend between the corner regions of plates 166 and 167 to secure the plates together. The ball is lifted from chute 149 to the ball release location 169 by a rotable ball carrier plate 172 situated between the fixed guide plates 166 and 167. Carrier plate 172 is turned by an electrical motor 173 that is mounted at the back of housing 12. Motor 173 is coupled to carrier plate 172 through a speed reduction gearbox 174 and a short drive shaft 176 that supports the carrier plate in addition to turning the plate.

Carrier plate 172 has four circular openings 177 situated at equiangular intervals around the periphery of the plate and which are of sufficient size to receive the returned ball from chute 132 through an opening 179 in the front guide plate 167. A dropped ball which enters one of the openings 177 in this manner is carried up to the release location 169 by the rotation of the carrier plate 172.

Means 191 act to eject the ball from the opening 179 at the release location into another inclined chute 192 that returns the ball to the game board at the back of the center of the board. Such means 191 in this embodiment includes a resilient blade 193 that extends diagonally into the path of the ball between the rear guide plate 166 and the carrier plate 172. Blade 193 urges the ball forwardly through another opening 194 in the front guide plate 167 and onto the release chute 192.

Motor 173 may be operated continuously during a period of play or another electrical switch 196 may be secured to the rear guide plate 166 in position to detect the approach of a ball towards the release location 169. The signal provided by switch 196 may be used to deactivate motor 173 a short interval after the ball approach is sensed and the signal from any of the previously described switches 163 may be used to reactivate the motor when another dropped ball enters the collector 137.

Figure 12A:
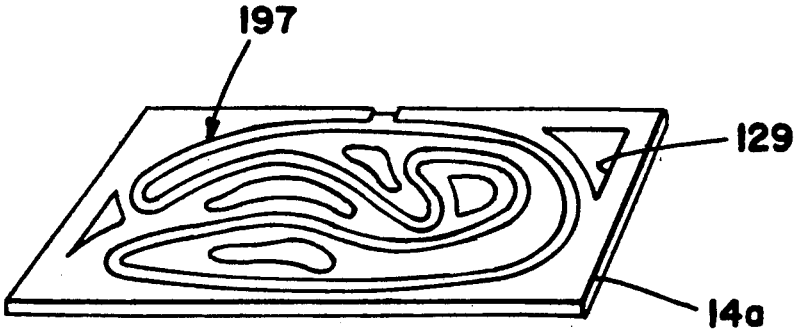
FIGS. 12A and 12B are perspective depictions of differing game boards that can interchangeably be used in the apparatus of the preceding figures.
Figure 12B:
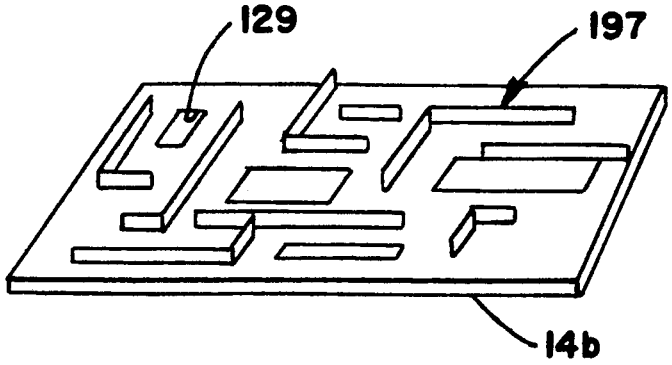

Referring to FIGS. 12A and 12B, the interchangeable game boards such as 14*a* and 14*b* may be of any of a variety of different designs to enable different methods of play and scoring. As one example, the game board 14*a* has a continuous, convoluted shallow groove 197 bordered by open areas 129 through which the ball may be dropped. The object of this game is make as many laps of the ball around the course defined by groove 129 as can be accomplished in a fixed time without loss of the ball. As another example, the game board 12*b* has spaced apart upright projections 197 arranged to define a labyrinth and also has open areas 129. The object of the game is to travel the ball through the maze from a starting point to a finish point in fixed time, again without loss of the ball through the open areas.

Figure 14:
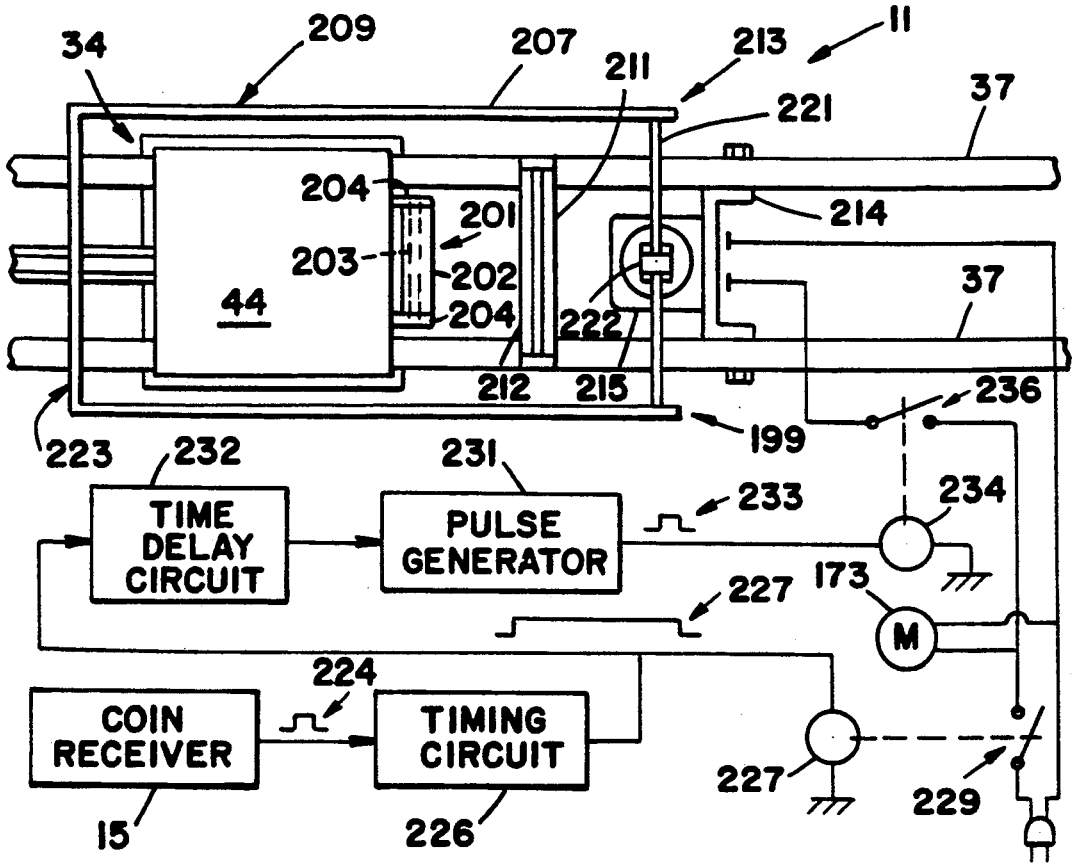
FIG. 14 is in part a plane view of the mechanism of FIG. 13 taken along line 14—14 thereof and in part a schematic circuit diagram of suitable electrical components for controlling the game terminating mechanism.
Figure 13:
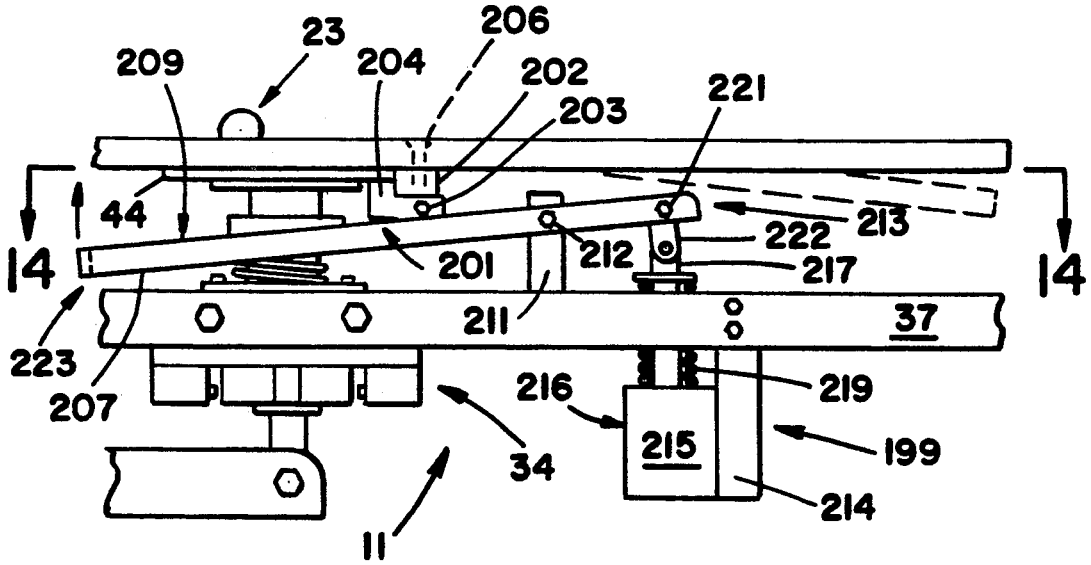
FIG. 13 is a side elevation view of the mechanism which supports the game board showing additional components which can be used to terminate operation of the game apparatus after a predetermined time interval has elapsed.

Coin operated games in arcades or the like are usually arranged to shut down after a predetermined fixed period. Referring jointly to FIGS. 13 and 14, the previously described game apparatus 11 may include additional means 199 for terminating play after a fixed interval. Means 199 forcibly tilts the game board 14 independently of the player's actions to assure dropping of the ball and also opens the current flow path to motor 173 of the ball lifting mechanism 133 to prevent retrieval of the ball until another coin is deposited.

When game terminating means 199 of this kind is to be used, the game board 14 is not directly fastened to the platform 44 of the board positioning assembly 34 as in the previously described embodiment and is linked to the platform by a pivot assembly 201 which enables the board to be tilted independently of the player's control lever manipulations and to a greater extent than is possible by manipulation of the control lever.

Pivot assembly 201 in this example includes a pivot block 202 situated behind platform 44 and which is supported by a transverse rod 203 that extends between spaced apart brackets 204 that are secured to the underside of the platform and which extend a short distance downward and backward from the platform. The game board is secured to block 202 by screws 206. As the pivot axis defined by rod 203 is situated to the rear of the center of gravity of game board 14, gravity acts to hold the board in parallel relationship with platform 44 and in contact with the platform until it is forcibly tilted about the pivot axis defined by rod 203 at the end of a game.

Such tilting is brought about by a U-shaped bail 207 which extends around the board positioning assembly 34, in spaced apart relationship with that assembly, and which has opposite arms 209 that extend rearwardly from the location of that assembly. Bail arms 209 are pivoted to a bail support 211, by another transverse rod 212, the support being secured to linear members 37. The bail pivot axis defined by rod 212 is situated behind the board positioning assembly 34 but forward from the back ends 213 of bail arms 209. An electrical actuator 215 is situated below the back ends 213 of bail arms 209 and is secured to a support bracket 214 that extends between the linear members 37 and which is secured to the members 37.

Actuator 215 may be of the known type having a solenoid coil 216 and a plunger armature 217 that extends from the coil when it is unenergized and which retracts towards the coil when it is energized in response to the magnetic field created by energizing of the coil. A spring 219 biases the armature 217 towards the extended position.

Another transverse rod 221 extends between the back ends 213 of bail arms 209 and through the upper end of a short link 222 which has a lower end pivotably coupled to the upper end of armature 217.

Thus when actuator 215 is unenergized, game board 14 lays flat against platform 44 and the game may be played in the manner previously described without interference from the game terminating mechanism 199. At the end of a fixed period of time, actuator 215 is energized. This draws the back ends 213 of the bail arms downward and therefore pivots the front end 223 of bail 207 upward. The front end 223 contacts the underside of board 14 and then tilts the board about the pivot axis defined by rod 203. The above described components are proportioned to provide a degree of tilting that assures that the ball 23 rolls off the board and is dropped to the previously described ball intercepting means.

Coin receivers 15 of the type used in arcade games generate an electrical signal 224 in response to deposit of a coin. Signal 224 may be used to initiate a fixed time period after which the actuator 215 is temporarily energized to end the game. For example, the signal 224 may trigger a timing circuit 226 of the known type which produces an output voltage, represented by wave-form 227 in FIG. 14, for a fixed period of time following such triggering. The output voltage is transmitted to a first relay driver coil 227 which responds by closing a first normally open switch 229 during the period that the voltage is being received. Closure of switch 229 applies operating current to the previously described ball retriever drive motor 173 to deliver the ball to game board 14. Switch 229 opens to stop the motor 173 when driver coil 227 is de-energized at the end of the fixed period of time.

The output voltage 227 of timing circuit 226 is also transmitted to a time delay circuit 232 which triggers a pulse generator 231 at a predetermined time after the beginning of each output voltage 227. The delay period is selected to cause pulse generator 231 to output a brief voltage pulse 233 at the time that the output voltage 227 of timing circuit 226 terminates. The voltage pulse 233 briefly energizes a second relay driver coil 234 which responds by briefly closing a second normally open switch 236 through which operating current is supplied to the bail pivoting actuator 215. Thus the game board is tilted in the previously described manner to drop the ball from the board after which de-energizing of driver coil 234 de-energizes the actuator 213 and gravity causes the board to return to a horizontal orientation.

While the invention has been described with respect to certain specific embodiments for purposes of example, many variations and modifications are possible and it is not intended to limit the invention except as defined in the following claims.

We claim:

1. An amusement apparatus having a rolling ball, a game board, an upwardly extending shaft that is situated below a central region of the board, said game board being secured to said shaft and being supported thereby, a shaft support that enables tilting of the shaft and board in any selected direction, a control lever and a control lever support that enables pivoting of said control lever in any selected direction and having means for tilting said shaft and board in response to pivoting of said control lever whereby a player may control the movement of said rolling ball on the surface of said board, wherein the improvement comprises:

said means for tilting said shaft and board includes a rigid link extending from said control lever to said shaft, a first pivoting coupling connecting said link to said shaft and a second pivot coupling connecting said link to said control lever, said first and second pivot couplings being oriented to enable pivoting of said shaft relative to said link only about a first rotational axis that is parallel with said game board surface and to enable pivoting of said control lever relative to said link only about a second rotational axis that is parallel with said first rotational axis, and means for preventing rotary motion of said shaft about the longitudinal axis of said shaft and for preventing rotary motion of said control lever about the longitudinal axis of said control lever, wherein a portion of said shaft has a ball shaped enlargement and wherein said shaft support has a socket chamber with a conforming annular wall region that forms a seat for said enlargement to enable said tilting of said shaft, said shaft further having a passage within said enlargement that is orthogonal to said first axis, said passage being of minimum height at the center thereof and having upper and lower walls which diverge from each other towards the ends of said passage, the width of said passage being the same at said center thereof and at said ends thereof, and wherein said means for preventing rotary motion of said shaft includes a cylindrical pin extending through said passage and into said shaft support, said pin having a diameter that conforms with said width of said passage.

2. The apparatus of claim 1 wherein said height of said passage at said center thereof is greater than said width of said passage at said center thereof.

3. The apparatus of claim 1 further including a first annular spring retainer disposed in coaxial relationship with said shaft between said enlargement thereof and said game board, and a first spring disposed in coaxial relationship with said shaft between said shaft support and said first spring retainer to provide a resilient force which resists said tilting of said game board.

4. The apparatus of claim 3 further including a second annular spring retainer disposed in coaxial relationship with said shaft below said enlargement thereof and being spaced apart from said enlargement, means for limiting downward movement of said second spring retainer along said shaft, and a second spring disposed in coaxial relationship with said shaft between said shaft support and said second spring retainer to provide an additional resilient force that resists tilting of said shaft.

5. The apparatus of claim 3 further including an annular collar encircling said shaft in coaxial relationship therewith and being in abutment with said enlargement and a third spring disposed in coaxial relationship with said shaft between said collar and said first spring retainer to urge said collar and said enlargement towards said seat.

6. The apparatus of claim 5 wherein said collar has a diameter that is less than the diameter of the adjacent region of said socket chamber and limits said tilting of said shaft by abutment with said adjacent region of said socket chamber.

7. An amusement apparatus having a rolling ball, a game board, an upwardly extending shaft that is situated below a central region of the board, said game board being secured to said shaft and being supported thereby, a shaft support that enables tilting of the shaft and board in any selected direction, a control lever and a control lever support that enables pivoting of said control lever in any selected direction and having means for tilting said shaft and board in response to pivoting of said control lever whereby a player may control the movement of said rolling ball on the surface of said board, wherein the improvement comprises:

said means for tilting said shaft and board includes a rigid link extending from said control lever to said shaft, a first pivoting coupling connecting said link to said shaft and a second pivot coupling connecting said link to said control lever, said first and second pivot couplings being oriented to enable pivoting of said shaft relative to said link only about a first rotational axis that is parallel with said game board surface and to enable pivoting of said control lever relative to said link only about a second rotational axis that is parallel with said first rotational axis, and means for preventing rotary motion of said shaft about the longitudinal axis of said shaft and for preventing rotary motion of said control lever about the longitudinal axis of said control lever, wherein said control lever has a distal end adapted for grasping by said player and has a ball shaped enlarged region spaced away from said distal end and has a passage in said enlarged region that extends orthogonally relative to said second rotational axis, said passage being of minimal height at the center thereof and having upper and lower walls that diverge from each other towards each end of the passage, the width of said passage being the same at said center thereof and at said ends thereof, and wherein said control lever support has a socket chamber in which said enlarged region of said control lever is seated and which has an annular wall region that conforms with said enlarged region, and wherein said means for preventing rotary motion includes a cylindrical pin extending through said passage and into said control lever support, said pin having a diameter that conforms with said width of said passage.

8. The apparatus of claim 7 wherein said height of said passage at said center thereof is greater than said width of said passage at said center thereof.

9. The apparatus of claim 7 further including a first annular spring retaining member disposed in coaxial relationship with said control lever between said enlarged region and said distal end thereof, and a first control lever biasing spring disposed in coaxial relationship with said control lever between said control lever support and said first spring retaining member to provide a resilient force which resists said tilting of said control lever.

10. The apparatus of claim 9 further including a second annular spring retaining member disposed in coaxial relationship with said control lever below said enlarged region thereof and being spaced apart from said enlarged region, means for limiting downward movement of said second spring retaining member along said control lever, and a second control lever biasing spring disposed in coaxial relationship with said control lever between said second spring retaining member and said control lever support to provide an additional resilient force which resists said tilting of said control lever.

11. The apparatus of claim 9 further including an annular collar encircling said control lever in coaxial relationship therewith and being in abutment with said enlarged region thereof, and an additional spring disposed in coaxial relationship with said control lever between said annular collar and said first spring retaining member to urge said annular collar against said enlarged region.

12. The apparatus of claim 11 wherein said annular element has a diameter that is smaller than the diameter of the adjacent region of said socket chamber and limits said tilting by abutment with said adjacent region of said socket chamber.

13. An amusement apparatus having a rolling ball, a game board, an upwardly extending shaft that is situated below a central region of the board, said game board being secured to said shaft and begin supported thereby, a shaft support that enables tilting of the shaft and board in any selected direction, a control lever and a control lever support that enables pivoting of said control lever in any selected direction and having means for tilting said shaft and board in response to pivoting of said control lever whereby a player may control the movement of said rolling ball on the surface of said board, wherein the improvement comprises:

said means for tilting said shaft and board includes rigid link extending from said control lever to said shaft, a first pivoting coupling connecting said link to said shaft and a second pivot coupling connecting said link to said control lever, said first and second pivot couplings being oriented to enable pivoting of said shaft relative to said link only about a first rotational axis that is parallel with said game board surface and to enable pivoting of said control lever relative to said link only about a second rotational axis that is parallel with said first rotational axis, and means for preventing rotary motion of said shaft about the longitudinal axis of said shaft and for preventing rotary motion of said control lever about the longitudinal axis of said control lever, wherein said shaft tilts about an intermediate portion of said shaft and said control lever pivots about an intermediate portion of said lever and wherein said first pivot coupling is situated below said intermediate portion of said shaft and said second pivot coupling is situated below said intermediate portion of said control lever.

14. An amusement apparatus having a rolling ball, a game board, an upwardly extending shaft that is situated below a central region of the board, said game board being secured to said shaft and being supported thereby, a shaft support that enables tilting of the shaft and board in any selected direction, a control lever and a control lever support that enables pivoting of said control lever in any selected direction and having means for tilting said shaft and board in response to pivoting of said control lever whereby a player may control the movement of said rolling ball on the surface of said board, wherein the improvement comprises:

said means for tilting said shaft and board includes a rigid link extending from said control lever to said shaft, a first pivoting coupling connecting said link to said shaft and a second pivot coupling connecting said link to said control lever, said first and second pivot couplings being oriented to enable pivoting of said shaft relative to said link only about a first rotational axis that is parallel with said game board surface and to enable pivoting of said control lever relative to said link only about a second rotational axis that is parallel with said first rotational axis, and means for preventing rotary motion of said shaft about the longitudinal axis of said shaft and for preventing rotary motion of said control lever about the longitudinal axis of said control lever, further including a housing having an externally visible chamber in which said game board is situated, further including at least one rigid structural member to which both said shaft support and said control lever support are secured whereby said shaft support and control lever support are unitized and held in fixed relationship to each other independently of said housing.

15. An amusement apparatus having a rolling ball, a game board, an upwardly extending shaft that is situated below a central region of the board, said game board being secured to said shaft and being supported thereby a shaft support that enables tilting of the shaft and board in any selected direction, a control lever and a control lever support that enables pivoting of said control lever in any selected direction and having means for tilting said shaft and board in response to pivoting of said control lever whereby a player may control the movement of said rolling ball on the surface of said board, wherein the improvement comprises:

said means for tilting said shaft and board includes a rigid link extending from said control lever to said shaft, a first pivoting coupling connecting said link to said shaft and a second pivot coupling connecting said link to said control lever, said first and second pivot couplings being oriented to enable pivoting of said shaft relative to said link only about a first rotational axis that is parallel with said game board surface and to enable pivoting of said control lever relative to said link only about a second rotational axis that is parallel with said first rotational axis, and means for preventing rotary motion of said shaft about the longitudinal axis of said shaft and for preventing rotary motion of said control lever about the longitudinal axis of said control lever, wherein said shaft has a game board supporting platform at the upper end thereof and wherein said game board is secured to said platform by disengagable fasteners and is supported solely by said platform and said shaft whereby said game board can be quickly replaced with another different game board.

16. An amusement apparatus having a rolling ball, a game board, an upwardly extending shaft that is situated below a central region of the board, said game board being secured to said shaft and being supported thereby, a shaft support that enables tilting of the shaft and board in any selected direction, a control lever and a control lever support that enables pivoting of said control lever in any selected direction and having means for tilting said shaft and board in response to pivoting of said control lever whereby a player may control the movement of said rolling ball on the surface of said board, wherein the improvement comprises:

said means for tilting said shaft and board includes a rigid link extending from said control lever to said shaft, a first pivoting coupling connecting said link to said shaft and a second pivot coupling connecting said link to said control lever, said first and second pivot couplings being oriented to enable pivoting of said shaft relative to said link only about a first rotational axis that is parallel with said game board surface and to enable pivoting of said control lever relative to said link only about a second rotational axis that is parallel with said first rotational axis, and means for preventing rotary motion of said shaft about the longitudinal axis of said shaft and for preventing rotary motion of said control lever about the longitudinal axis of said control lever, wherein said game board has openings through which said ball may drop to the region underlying said game board, further including means for intercepting said ball when it has dropped through an opening and for returning the intercepted ball to a retrieval location, and means for guiding the intercepted ball to said retrieval location along different routes when said ball drops from different areas of said game board surface, further including means for detecting which of said routes is traveled by said intercepted ball to reach said retrieval location whereby different scorings may be assigned to a player depending on the particular area of said game board at which said ball was dropped.

17. An amusement apparatus having a rolling ball, a game board, an upwardly extending shaft that is situated below a central region of the board, said game board being secured to said shaft and being supported thereby, a shaft support that enables tilting of the shaft and board in any selected direction, a control lever and a control lever support that enables pivoting of said control lever in any selected direction and having means for tilting said shaft and board in response to pivoting of said control lever whereby a player may control the movement of said rolling ball on the surface of said board, wherein the improvement comprises:

said means for tilting said shaft and board includes a rigid link extending from said control lever to said shaft, a first pivoting coupling connecting said link to said shaft and a second pivot coupling connecting said link to said control lever, said first and second pivot couplings being oriented to enable pivoting of said shaft relative to said link only about a first rotational axis that is parallel with said game board surface and to enable pivoting of said control lever relative to said link only about a second rotational axis that is parallel with said first rotational axis, and means for preventing rotary motion of said shaft about the longitudinal axis of said shaft and for preventing rotary motion of said control lever about the longitudinal axis of said control lever, wherein said game board has openings through which said ball may drop to the region underlying said game board, further including means for intercepting said ball when it has dropped through an opening and for returning the intercepted ball to a retrieval location, and means for guiding the intercepted ball to said retrieval location along different routes when said ball drops from different areas of said game board surface, wherein said means for intercepting said ball includes a first tilted tray extending beneath said game board and having an opening along the lower edge through which said ball may roll towards said retrieval location, a second tilted tray of smaller size than said first tray and which overlays only a portion of said first tray, said second tray also having an opening at the lower edge through which said ball may roll towards said retrieval location, said first and second trays being spaced apart by a distance at least equal to the diameter of said ball.

18. An amusement apparatus having a rolling ball, a game board, an upwardly extending shaft that is situated below a central region of the board, said game board being secured to said shaft and being supported thereby, a shaft support that enables tilting of the shaft and board in any selected direction, a control lever and a control lever support that enables pivoting of said control lever in any selected direction and having means for tilting said shaft and board in response to pivoting of said control lever whereby a player may control the movement of said rolling ball on the surface of said board, wherein the improvement comprises:

said means for tilting said shaft and board includes a rigid link extending from said control lever to said shaft, a first pivoting coupling connecting said link to said shaft and a second pivot coupling connecting said link to said control lever, said first and second pivot couplings being oriented to enable pivoting of said shaft relative to said link only about a first rotational axis that is parallel with said game board surface and to enable pivoting of said control lever relative to said link only about a second rotational axis that is parallel with said first rotational axis, and means for preventing rotary motion of said shaft about the longitudinal axis of said shaft and for preventing rotary motion of said control lever about the longitudinal axis of said control lever, wherein said game board has openings through which said ball may drop to the region underlying said game board, further including means for intercepting said ball when it has dropped through an opening and for returning the intercepted ball to a retrieval location, and means for guiding the intercepted ball to said retrieval location along different routes when said ball drops from different areas of said game board surface, wherein said means for intercepting said ball includes a first tilted tray extending beneath said game board and having an opening along the lower edge through which said ball may roll towards said retrieval location, a second tilted tray of smaller size than said first tray and which overlays only a portion of said first tray, said second tray also having an opening at the lower edge through which said ball may roll towards said retrieval location, further including first and second ball deflectors disposed in said first and second trays respectively at locations adjacent said lower edges thereof, each of said ball deflectors having opposite side surfaces that are convergent in the direction of the high ends of the trays, and wherein said means for guiding intercepted balls to said retrieval location includes at least four troughs each having a lower end at said retrieval location, a first pair of said troughs having upper ends which are at opposite sides of said first ball deflector and a second pair of said troughs having upper ends which are at opposite sides of said second ball deflector.

19. An amusement apparatus having a rolling ball, a game board, an upwardly extending shaft that is situated below a central region of the board, said game board being secured to said shaft and being supported thereby, a shaft support that enables tilting of the shaft and board in any selected direction, a control lever and a control lever support that enables pivoting of said control lever in any selected direction and having means for tilting said shaft and board in response to pivoting of said control lever whereby a play may control the movement of said rolling ball on the surface of said board, wherein the improvement comprises:

said means for tilting said shaft and board includes a rigid link extending from said control lever to said shaft, a first pivoting coupling connecting said link to said shaft and a second pivot coupling connecting said link to said control lever, said first and second pivot couplings being oriented to enable pivoting of said shaft relative to said link only about a first rotational axis that is parallel with said game board surface and to enable pivoting of said control lever relative to said link only about a second rotational axis that is parallel with said first rotational axis, and means for preventing rotary motion of said shaft about the longitudinal axis of said shaft and for preventing rotary motion of said control lever about the longitudinal axis of said control lever, wherein said game board has openings through which said ball may drop to the region underlying said game board, further including means for intercepting said ball when it has dropped through an opening and for returning the intercepted ball to a retrieval location, and means for guiding the intercepted ball to said retrieval location along different routes when said ball drops from different ares of said game board surface, further including first and second guide plates having lower ends adjacent said ball retrieval location and being spaced apart sufficiently to receive said ball therebetween and which extend upward to a ball release location situated adjacent said game board, a rotatable ball carrier plate disposed between said guide plates and having at least one opening located to receive said intercepted ball from said ball retrieval location, a motor coupled to said ball carrier plate to turn said carrier plate and thereby carry said ball upward to said ball release location, and means for ejecting said ball from said carrier plate opening at said ball release location.

20. An amusement apparatus having a rolling ball, a game board, an upwardly extending shaft that is situated below a central region of the board, said game board being secured to said shaft and being supported thereby, a shaft support that enables tilting of the shaft and board in any selected direction, a control lever and a control lever support that enables pivoting of said control lever in any selected direction and having means for tilting said shaft and board in response to pivoting of said control lever whereby a player may control the movement of said rolling ball on the surface of said board, wherein the improvement comprises:

said means for tilting said shaft and board includes a rigid link extending from said control lever to said shaft, a first pivoting coupling connecting said link to said shaft and a second pivot coupling connecting said link to said control lever, said first and second pivot couplings being oriented to enable pivoting of said shaft relative to said link only about a first rotational axis that is parallel with said game board surface and to enable pivoting of said control lever relative to said link only about a second rotational axis that is parallel with said first rotational axis, and means for preventing rotary motion of said shaft about the longitudinal axis of said shaft and for preventing rotary motion of said control lever about the longitudinal axis of said control lever, wherein said game board has at least one opening through which said ball may drop to the region underlying said game board, at least one tray disposed beneath said game board in position to intercept balls which drop therefrom, said tray being inclined to cause said intercepted balls to roll to a ball retrieval location, first and second guide plates having lower ends adjacent said ball retrieval location and being spaced apart sufficiently to receive said intercepted balls therebetween and which extends upward to a ball release location situated adjacent said game board, a rotatable ball carrier plate disposed between said guide plates and having at least one opening located to receive said intercepted balls from said ball retrieval location, a motor coupled to said ball carrier plate to turn said carrier plate and thereby carry said balls upward to said ball release location, and means for ejecting said balls from said carrier plate opening at said ball release location.

21. An amusement apparatus having a rolling ball, a game board, an upwardly extending shaft that is situated below a central region of the board, said game board being secured to said shaft and being supported thereby, a shaft support that enables tilting of the shaft and board in any selected direction, a control lever and a control lever support that enables pivoting of said control lever in any selected direction and having means for tilting said shaft and board in response to pivoting of said control lever whereby a player may control the movement of said rolling ball on the surface of said board, wherein the improvement comprises:

said means for tilting said shaft and board includes a rigid link extending from said control lever to said shaft, a first pivoting coupling connecting said link to said shaft and a second pivot coupling connecting said link to said control lever, said first and second pivot couplings being oriented to enable pivoting of said shaft relative to said link only about a first rotational axis that is parallel with said game board surface and to enable pivoting of said control lever relative to said link only about a second rotational axis that is parallel with said first rotational axis, and means for preventing rotary motion of said shaft about the longitudinal axis of said shaft and for preventing rotary motion of said control lever about the longitudinal axis of said control lever, further including a plurality of electrical switches secured to at least one of said shaft support and said control lever support in positions at which said switches are actuated by tilting of said control lever and shaft in any of a plurality of different directions to enable generation of at least one of audio effects and visual effects in response to said tilting.

22. An amusement apparatus with which a player endeavors to guide a rolling ball along a particular path on the surface of a game board by manipulating a control lever that controls the inclination of the game board, comprising:

a housing having a chamber therein that is visible by the player, a rolling ball, a tiltable rectangular game board disposed in said chamber and having at least one opening through which said ball may drop into the region underlying said game board, a tiltable shaft disposed below a central region of said game board and having an upper end to which said game board is rigidly fastened, said tiltable shaft having an enlarged region thereon at a location that is away from said upper end thereof, said shaft further having a passage which extends through said enlarged region and which has a central region of minimum size and upper and lower walls that diverge from each other towards each end of said passage and which has a width that is the same at said central region and at said ends thereof, a shaft support having a first socket cavity in which said enlarged region of said shaft is seated to enable said tilting of said shaft and game board, a pin extending through said passage in said shaft and extending into said shaft support to hold said enlarged region of said shaft in said first socket cavity and to prevent rotational motion of said shaft about the longitudinal axis of said shaft, an annular spring retainer disposed on said shaft in coaxial relationship therewith at a location thereon that is spaced apart from said enlarged region thereof, at least one compression ring disposed on said shaft in coaxial relationship therewith and having ends which bear against said spring retainer and said shaft support whereby said spring resists said tilting of said shaft and game board, a rigid structural member extending from said shaft support, a control lever support secured to said structural member and having a second socket cavity, a tiltable control lever having an upper end adapted for grasping by the player and having an enlargement at a lower location that is spaced apart from said upper end and which is seated in said second socket cavity, means for retaining said control lever enlargement in said second socket cavity, a rigid link extending between said control lever and said shaft, and a first pivot coupling connecting said link to said shaft and a second pivot coupling connecting said link to said control lever, said couplings being oriented to enable pivoting of said link relative to said shaft and said lever only about pivot axes that are parallel to said surface of said game board.

23. An amusement apparatus having a rolling ball, a game board, an upwardly extending shaft that is situated below a central region of the board, said game board being secured to said shaft and being supported thereby, a shaft support that enables tilting of the shaft and board in any selected direction, a control lever and a control lever support that enables pivoting of said control lever in any selected direction and having means for tilting said shaft and board in response to pivoting of said control lever whereby a player may control the movement of said rolling ball on the surface of said board, wherein the improvement comprises:

said means for tilting said shaft and board includes a rigid link extending from said control lever to said shaft, a first pivoting coupling connecting said link to said shaft and a second pivot coupling connecting said link to said control lever, said first and second pivot couplings being oriented to enable pivoting of said shaft relative to said link only about a first rotational axis that is parallel with said game board surface and to enable pivoting of said control lever relative to said link only about a second rotational axis that is parallel with said first rotational axis, and means for preventing rotary motion of said shaft about the longitudinal axis of said shaft and for preventing rotary motion of said control lever about the longitudinal axis of said control lever, further including means for terminating a period of play after a period of time by tilting said game board independently of the position of said control lever whereby said ball is rolled off of said game board.

24. The apparatus of claim 23 further including a platform secured to the top of said shaft and wherein said game board rests on said platform during said period of play, a pivot coupling attaching said game board to said platform and having a horizontal pivot axis that is spaced away from the center of gravity of said board, and wherein said means for terminating a period of play includes an electrical actuator and means for energizing said actuator at the end of said period of time and linkage means for pivoting said board about said horizontal pivot axis in response to energization of said actuator.

* * * * *